US005759110A

United States Patent [19]

Seibel et al.

[11] Patent Number: 5,759,110

[45] Date of Patent: Jun. 2, 1998

[54] SWING TRAINING DEVICE

[76] Inventors: Chad R. Seibel, 300 Front St., Mount Pleasant, Pa. 15666; Tatsuo Inoue, 3-25-9 Midori-Cyo, Fucyu-Si, Tokyo, Japan, 183

[21] Appl. No.: 808,487

[22] Filed: Mar. 3, 1997

[51] Int. Cl.[6] ..... A63B 69/36; F21K 7/00

[52] U.S. Cl. ..... 473/220; 362/259

[58] Field of Search ..... 473/220; 362/259

[56] References Cited

U.S. PATENT DOCUMENTS

| | | | |
|---|---|---|---|
| 3,953,034 | 4/1976 | Nelson | 273/186 C |
| 4,913,441 | 4/1990 | Freer | 473/220 |
| 4,971,328 | 11/1990 | Hernberg | 273/186 A |
| 5,082,282 | 1/1992 | Hernberg | 273/186 A |
| 5,161,802 | 11/1992 | Daechsel | 473/220 |
| 5,217,228 | 6/1993 | DeAguilar | 473/220 |
| 5,269,528 | 12/1993 | McCardle | 473/220 X |
| 5,277,428 | 1/1994 | Goodwin et al. | 273/186.2 |
| 5,388,831 | 2/1995 | Quadri et al. | 273/186.3 |
| 5,544,888 | 8/1996 | Pellegrini | 473/220 |

*Primary Examiner*—George J. Marlo

*Attorney, Agent, or Firm*—Webb Ziesenheim Bruening Logsdon Orkin & Hanson, P.C.

[57] ABSTRACT

A swing training device includes a housing which contains a light source, a power source and a driving circuit for generating a beam, such as a laser beam. Suitable optics, such as a collimator lens and a beam splitter (such as a half-mirror or a prism) are placed in the housing in order to split a highly defined beam so that a first beam is radiated along the longitudinal axis of the golf club shaft and a second beam is radiated at roughly a 90° angle with respect to the first beam. A gravity switch in the swing training device provides that the beams are only radiated during the backswing and follow through of a golf club, thus simplifying operation, saving power and reducing the likelihood of inadvertent radiation of the laser beam into the face of the golfer or bystanders. The invention may also include a mat which has indicia for properly aligning lighted dots generated on the mat by the laser beams in order that the golfer may develop a proper swing form. The housing has a nesting portion which is received within an upper open end of a golf club shaft. The housing is removably secured to the golf club shaft by a collar and set screw arrangement. The cap on the housing may be rotatable to provide for radial adjustment of the second beam, to suit the needs of the golfer.

36 Claims, 3 Drawing Sheets

SWING TRAINING DEVICE

BACKGROUND OF THE INVENTION

1. Field of the Invention

The present invention is related to devices for training a golfer to improve his or her golf swing and, more particularly, to such training devices which incorporate a laser beam.

2. Description of Prior Art

In order to be successful at the game of golf, a golfer must be able to strike the ball with a golf club in a manner which results in the ball traveling toward the target with maximum distance and accuracy. Generally, assuming the golfer is properly aligned toward the target at address, maximum distance and accuracy will be achieved if the ball is struck with the golf club head traveling along the target line and being at a right angle to the ball. The ideal club head alignment at impact may only be achieved with the proper backswing and follow through with the golf club. For example, a swing which causes the club head to travel in an outside to inside path across the target line would typically result in the ball exhibiting a "slice", traveling in the direction in which the golfer is facing at address instead of toward the target. A swing which causes the club head to exhibit an inside to outside path as it crosses the target line would typically result in the ball having a "hook", unacceptably causing the ball to fly opposite the direction the golfer is facing at address, again missing the target. It is therefore imperative that the backswing and follow through are properly aligned with respect to the target line so that the club head is in the proper position at impact, eliminating the possibility of a hook or a slice and causing the ball to travel accurately toward the target.

For most golfers, this proper swing form is not easy to obtain. Most amateur golfers fall into their own swing forms without noticing. It is very difficult to assess one's swing form without some type of feedback. Visual feedback is very helpful. Various devices have been proposed to assist golfers in obtaining the proper swing form by means of visual feedback.

U.S. Pat. Nos. 5,544,888 to Pellegrini and 4,913,441 to Freer disclose the general concept of placing a laser generating device in the grip end of a golf club for the purpose of emitting a laser beam outward along the longitudinal axis of the golf club. The laser light generating mechanism in Freer and Pellegrini generates a single dot on the floor, ground or surrounding surface which provides minimal visual feedback to the golfer respecting his swing. Both devices are operated by a manual on/off switch arrangement. Although providing no detailed description on the point, Freer mentions that it is also possible to provide a motion on/off switch which turns the power on when the device is in motion.

U.S. Pat. No. 5,217,228 to De Aguilar discloses a golf club including a light beam orienting device wherein the golf club has a laser generator capable of generating a light beam in a path parallel to the theoretical path of a ball after being struck by the club. The generator is located within the golf club grip, and a push button activates the generator. The generator emits a beam of light that travels axially down the inside of the club until it reaches a mirror, causing its path to be bent. The bent beam exits to the outside via an opening formed in the club, thereby giving a golfer a reference on the ground at which to aim the ball.

U.S. Pat. No. 5,161,802 to Daechsel discloses a flat base or backing having a target line thereon, with a practice target in the form of a golf ball having an electronic receiver.

U.S. Pat. No. 5,269,528 to McCardle, Jr. discloses a line physically drawn on the ground to assist in alignment, in connection with a shaft having a light means located in each end of the shaft.

Although the general concept of providing a golf club with a laser beam for swing training is disclosed in the prior art, there remains a need, particularly respecting irons and woods, for a golf club having a light beam generating device removably installed in the top of the golf club shaft, the device capable of emitting more than one beam of light to provide more than one reference point for the golfer to view during swing training, maximizing visual feedback. There also exists a need for a light beam generation device which does not require the golfer to unnaturally turn his head in order to view the lighted reference points. Furthermore, there exists a need to regulate the light beam to avoid the necessity of manual switching and avoid emission of the beam into the eyes of the person using the training device while conserving power. Furthermore, such a device should be uncomplicated and relatively easy and cheap to install on an existing golf club.

SUMMARY OF THE INVENTION

Accordingly, the present invention provides a device for use with a shaft to provide visual feedback to a user who is swinging the shaft. The device includes a power source, a light source and a driving circuit for driving the light source to emit a beam of light. A beam splitter converts the light beam into at least two parts, a first part being emitted along the axis of the shaft, a second part emitted at an angle with respect to the first part. A gravity switch regulates the light source so that the light source emits a light beam only when the shaft is in a predetermined position or positions.

In a preferred embodiment, the present invention provides a swing training device having a shaft with a grip end and a distal end opposite the grip end. A housing is removably secured to the grip end of the shaft. The housing has at least one battery, a laser driver, a laser diode, a collimating lens and a beam splitter. The housing has a nesting portion receivable in the grip end of the shaft.

The cap on the housing has a first port concentric with the longitudinal axis of the shaft and a second port whose central axis is perpendicular to the longitudinal axis of the shaft. The cap contains the beam splitter and may be rotatable about the longitudinal axis of the shaft.

A main switch activates and deactivates the laser driver. The main switch has a spring-loaded post which extends radially outward from the housing. A rotary sleeve on the housing defines a slot on the inner surface of the rotary sleeve. The slot has a greater inside diameter than a remainder of the rotary sleeve to receive the spring-loaded post. Reciprocating angular displacement of the sleeve about the longitudinal axis of the housing alternately depresses and releases the post, thereby activating and deactivating the laser driver.

A gravity switch is located in the housing. The gravity switch has two terminals and a pivoting magnet. The terminals contact one another to complete a circuit between the battery and the laser driver when the magnet is in a first position adjacent the terminals. The terminals move apart from one another when the magnet pivots to a second position removed from the terminals. The magnet pivots in response to the force of gravity when the shaft is being swung.

The invention may also include a mat which is placed in front of the user. The mat has indicia to provide additional visual feedback to the user respecting the position of points of light created by the light beams. The mat may have an alignment stripe, a first target zone and a second target zone.

The invention may also include a collar for joining the housing to the shaft, a lock washer for fixing the position of the rotary cap, and/or a lock washer for fixing the position of the rotary sleeve.

The gravity switch may be located within a casing that has the shape of a battery, with a positive contact on one end of the casing and a negative contact on an opposite end of the casing. The gravity switch casing and two batteries may be located within the nesting portion of the housing.

The beam splitter may be in the form of a half-mirror, or it may be in the form of a pair of wedge-shaped prisms, adhered together to form a cube.

When used in connection with a golf club, the present invention provides that the light beams are emitted only during the backswing and follow through of the golf club.

Further details and advantages of the invention may be seen from the following detailed description, in conjunction with the accompanying drawings, wherein like reference numerals represent like parts.

DETAILED DESCRIPTION OF THE PREFERRED EMBODIMENTS

Figure 1:
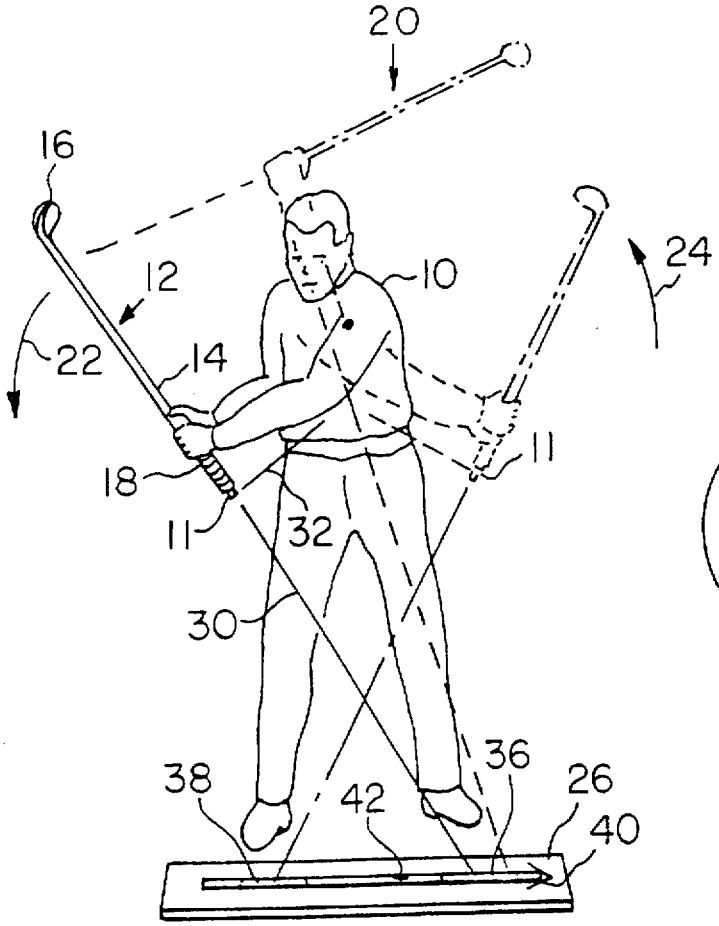
FIG. 1 is an elevation view showing a golfer using the swing training device of the present invention.

FIG. 1 illustrates a golfer 10 utilizing a swing training device 11 according to the present invention in connection with a golf club 12. The golf club 12 is of the iron or wood type, for hitting the golf ball relatively long distances from surfaces other than on the green, such as from the fairway, around the green, from a sandtrap or from a driving tee. Golf club 12 has a shaft 14, at one end of which is located a club head 16 and at the other end located a grip 18. The end of shaft 14 opposite club head 16 is otherwise known as the grip end. FIG. 1 illustrates a backswing position 20, foreswing 22 and follow through 24.

Mat 26 is located on the ground or floor in front of golfer 10 and has an alignment stripe 28 in the center of the mat. The alignment stripe is aligned with the target line along which a golf ball would be struck.

According to the invention, swing training device 11 extends from the grip end of shaft 14 opposite club head 16. Two light beams 30 and 32 are emitted from the swing training device 11. Light beam 30 is emitted along the longitudinal axis of shaft 14 away from the club head 16, whereas light beam 32 is emitted at an angle, preferably in a direction roughly perpendicular to light beam 30.

Light beams 30 and 32 create a red dot visible along alignment stripe 28 in mat 26, or on the floor or ground as the case may be, to provide visual feedback and assist the golfer in aligning his or her swing so that the club head 16 is properly aligned with the golf ball at impact along the intended target line. Since two beams 30 and 32 may be generated from the singular swing training device 11, the red dots are more readily apparent to the golfer 10 throughout the backswing, foreswing and follow through, thus resulting in greater visual feedback and a better appreciation of the golfer as to his swing position, even when the golf club is not fully visible to the golfer. The dots created by the light beams 30 and 32 are generally within the field of vision of the golfer 10 as he concentrates on the ball, or on the position where the ball would be in actual play. Thus, the golfer need not turn his head to view the dots, as would be the case with the prior art. Note, the swing training device according to the preferred embodiment of the present invention does not generate a visible beam as such, but rather generates a red dot on surfaces which intersect the beam, such as the ground, the floor or surrounding walls.

For added training feedback, mat 26 has a first target zone 36 and a second target zone 38, along with an arrow 40 and a cross mark 42. The mat 26 is oriented so that arrow 40 is pointed in the direction of the target. First target zone 36 is located within the alignment stripe 28 between cross mark 42 and arrow 40. Second target zone 38 is located within the alignment stripe 28 on the opposite side of cross mark 42, as shown in FIG. 1. Cross mark 42 represents the location of the golf ball, and the golfer 10 would use cross mark 42 to get into position adjacent mat 26 before swinging.

Target zones 36 and 38 assist the golfer 10 in learning proper position of the golf club 12 at the follow through and backswing, respectively. It is anticipated that the dimensions of mat 26 would be roughly 60 to 65 inches in length and 4 to 6 inches in width. Alignment stripe 28 would be roughly 2 inches in width.

Alignment stripe 28, target zone 36, cross mark 42 and target zone 38 would all be within the field of vision of the golfer 10 as he concentrates on the position of the ball represented by cross mark 42.

Figure 2:
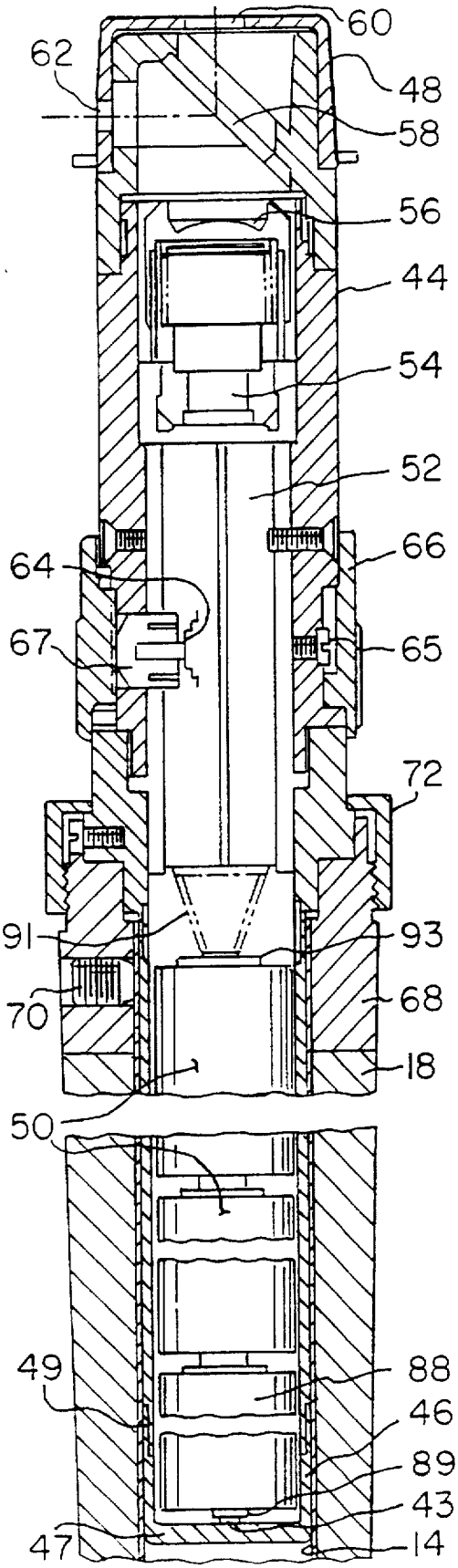
FIG. 2 is an elevation view in partial cross section, showing the swing training device of the present invention installed in the grip end of a golf club shaft.

Referring to FIG. 2, swing training device 11 extends axially outward from shaft 14 and grip 18 of golf club 12. swing training device 11 includes a housing 44 having a nesting portion 46 of smaller cross section than the remainder of housing 44 and a cap 48 opposite the nesting portion 46. Two batteries 50, which serve as a power source, are positioned within nesting portion 46, and the batteries 50 provide power to a laser driver 52 in the form of direct current electricity. Nesting portion 46 may be broken at threads 49 to remove and replace batteries 50. Laser driver 52 drives laser diode 54 to produce a laser beam. The laser beam is directed toward collimating lens 56, which produces a parallel laser light beam. The parallel laser light beam is directed toward half-mirror 58. A portion of the beam proceeds longitudinally past half-mirror 58 outward through first port 60. Half-mirror 58 reflects the remaining portion of the beam at a 90° angle through second port 62. The half-mirror 58 thus serves as a beam splitter. In order to reflect the beam 90°, half-mirror 58 faces collimating lens 56 and is oriented at an angle of 45° with the longitudinal axis of the golf club shaft 14 and housing 44.

Figure 8:
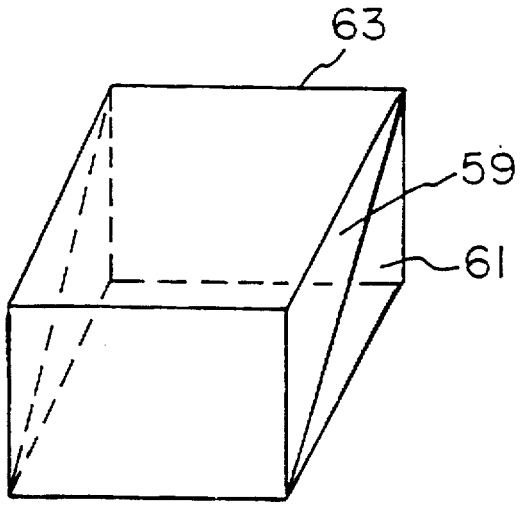
FIG. 8 is a perspective view of a prism arrangement for use as a beam splitter in the present invention.

The half-mirror 58 may be replaced by another beam splitter (shown in FIG. 8) which is made by adhering two wedge-shaped prisms 59 and 61, for example of glass or plastic material, to form a cube 63 which splits the beam coming out of collimating lens 56. Additionally, cap 48 may be rotatable about the longitudinal axis of housing 44 so that the perpendicular beam 32 may be adjusted in terms of its radial position about the axis of the housing 44. Although the preferred embodiment shows the beam 32 extending at a 90° angle to the axial light beam 30, this angle may be adjusted to suit the needs of the user. Adjustment of the light beam angle is accomplished by orienting the half-mirror 58 (or prisms) accordingly, as will be apparent to those skilled in the art.

Figure 9:
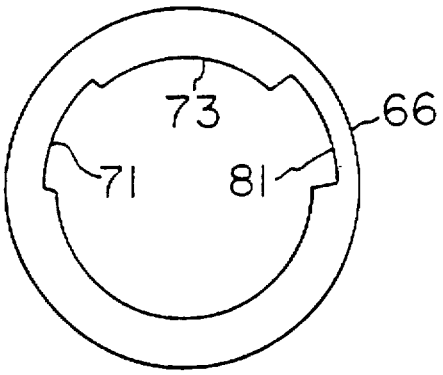
FIG. 9 is a plan view of a rotary sleeve for a main switch according to the present invention.

Main switch 64 is positioned to control laser driver 52. Particularly, main switch 64 has a springloaded post 67. Rotary sleeve 66 is angularly displaced about the axis of housing 44 to alternately depress the post 67 (thus activating the laser driver 52) and release the post 67 (thus deactivating the laser driver 52). Referring to FIG. 9, rotating sleeve 66 has a first milled portion 71 on its inner surface 73 so that the inside diameter of the sleeve is greater at the first milled portion 71. First milled portion 71 defines a slot to receive post 67. When the first milled portion 71 is aligned above the post 67, the main switch 64 is deactivated. When the sleeve 66 is rotated, the inner surface 73 of the sleeve 66 depresses the post 67 to activate the main switch 64 and laser driver 52. Set screw 65 is disposed in a second milled portion 81 of sleeve 66 to limit the range of angular motion of the sleeve 66. Milled portions 71 and 81 are not diametrically opposed from one another and milled portion 71 is not as deep and traces a longer arc than milled portion 81.

In order to secure the housing 44 to the golf club 12, a collar 68 is first secured to the end of shaft 14 by a set screw 70. Collar 68 receives nesting portion 46, which in turn is received within the inside diameter of shaft 14. Housing 44 may be secured to collar 68 by one of various arrangements. As shown in FIG. 2, collar 68 may contain threads 45 on an outer surface of the collar. A corresponding threaded sleeve 72 (having inside threads) would then hold the housing 44 in engagement with collar 68. The threaded sleeve could be removed, for example, to replace batteries 50 without the necessity of removing collar 68.

Figure 6:
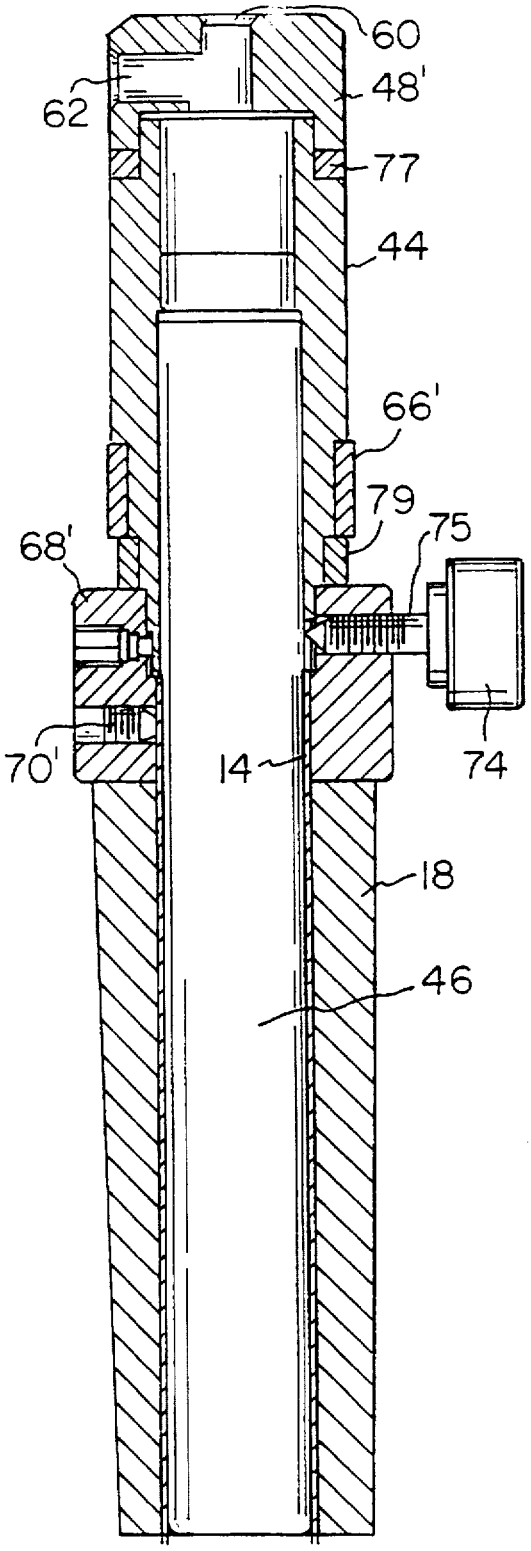
FIG. 6 is a side view, partially in section, showing a collar and set screw arrangement for use in securing the swing training device to a golf club shaft, according to a second embodiment of the present invention.
Figure 7:
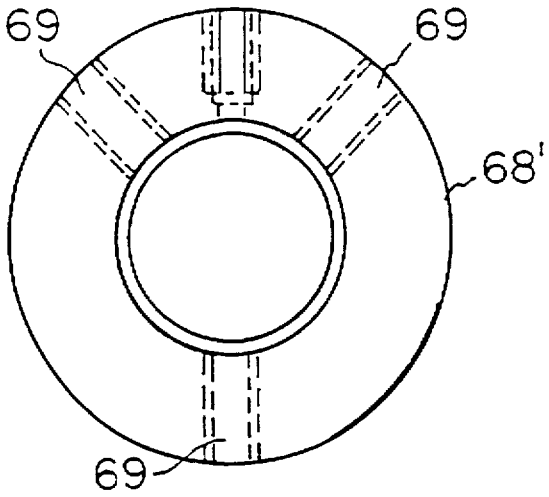
FIG. 7 is a plan view of the collar of FIG. 6.

Alternatively, as shown in FIG. 6, a knurled knob 74 may be located on collar 68', with an attached set screw 75 for securing the housing 44 within the collar 68'. Rotation of the knob 74 by the golfer 10 would allow securement and removal of the housing 44 as needed. FIG. 7 shows collar 68' with various drilled and tapped holes 69 for set screws to secure collar 68' to shaft 14. In any case, the collar arrangement allows for simple, inexpensive retrofitting of existing golf clubs with the swing training device of the present invention.

Those skilled in the art will recognize that the dimensions of the nesting portion 46 and collar 68, 68' must be such as to allow these devices to be installed within and on the outer diameter of conventional golf club shafts, respectively. Golf club shafts are typically hollow. To insert the swing training device on an existing golf club, one would cut the upper portion of the grip 18 to expose the shaft 14 and the opening within the shaft. Collar 68, 68' would then be secured on the exposed surface of the shaft 14 by set screws 70, 70'. Nesting portion 46 would then be inserted inside shaft 14, and threaded sleeve 72 (or knob 74) screwed down to hold the housing 44 securely to the collar 68, 68'. Other equivalent and suitable means for securing the housing 44 to the golf club 12 will be apparent to those skilled in the art, upon reading the instant specification.

Housing 44 may also have lock washer 77 adjacent cap 48' to hold the cap in position once it is adjusted to properly align the perpendicular beam 32 per the golfer's requirements. Likewise, lock washer 79 may be used to maintain sleeve 66' in position, for example where main switch 64 is on at all times.

Figure 3:
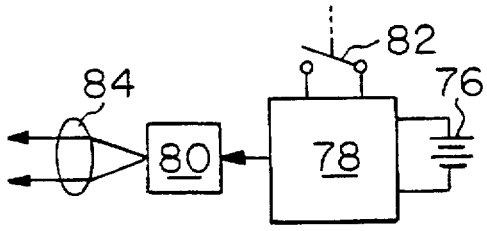
FIG. 3 is a circuit diagram for the swing training device of FIG. 2.

Referring to FIG. 3, a circuit diagram for the swing training device 11 is shown. Particularly, power source 76 is connected to driving circuit 78, which in turn drives light source 80. Switch 82 regulates driving circuit 78. Light source 80 emits a beam in the direction of collimator 84. The collimator 84 assures that the rays of the light beam are made parallel to one another. Making the light beam parallel is necessary to insure that the beam is concentrated and bright enough for use under normal daylight conditions. In the preferred embodiment described herein, power source 76 corresponds to batteries 50, driving circuit 78 corresponds to laser driver 52 and light source 80 corresponds to laser diode 54. Switch 82 corresponds to main switch 64, and collimator 84 corresponds to collimating lens 56.

Generally available dry batteries may be used for power source 76. Panasonic alkaline 1.5 volt batteries, having a length of approximately one and one-eighth (1⅛) inch and a diameter of approximately seven-sixteenths (7/16) inch have been found suitable. Power source 76 applies electricity to driving circuit 78. Essentially, driving circuit 78 consists of electronic circuitry sufficient to drive light source 80 with the supplied electricity. Light source 80 may take the form of a laser diode, as in the preferred embodiment, or alternatively constitute an LED or a single lightbulb, etc. The function of the light source, whatever its form, is to radiate a beam in the direction opposite the club head 16 of the golf club 12. Collimator 84 may be, for example, a glass or plastic convex lens set in the path of the beam in front of light source 80. The lens refracts the radiated beam to make it into a parallel beam. The collimated beam then radiates outwardly along the longitudinal axis of golf club shaft 14 in the direction opposite to club head 16. A laser beam is preferable since it is more direct and more bright than LED or simple lightbulb beams. In any case, the diameter of the radiated beam should be 3 to 15 millimeters to ensure adequate visibility.

Referring to FIG. 2, a gravity switch 86 for use with the present invention is shown. Gravity switch 86 overrides main switch 64, in terms of emitting the laser beam. However, main switch 64 must be on at all times if the laser beam is to be generated. Gravity switch 86 may be housed within casing 88. The casing 88 has the same shape as batteries 50. Casing 88 may be formed from a suitable plastic, having metallic contact points at either end. Nesting portion 46 has a positive contact point 43 at distal end 47 which engages a contact 89 on casing 88. Spring 91 is located at an opposite end of nesting portion 46 and engages a negative contact 93 on battery 50.

Figure 4:
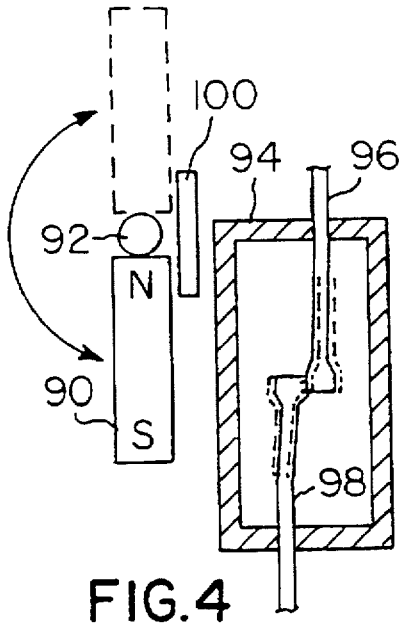
FIG. 4 is a schematic view showing a gravity switch according to the present invention.

Referring to FIG. 4, gravity switch 86 includes a magnet 90 which pivots about axis 92 and is positioned adjacent shell 94. Inside shell 94 are first terminal 96 and second terminal 98. Stopper 100 limits the range of motion of magnet 90 as it pivots about axis 92. When magnet 90 is in a first position adjacent the terminals 96 and 98, i.e., aligned along side and parallel to shell 94, the magnetic field of the magnet 90 causes terminals 96 and 98, which are normally biased apart from one another, to join in contact with one another, completing the circuit between the power source 76 (batteries 50) and driving circuit 78 (laser driver 52), causing light source 80 (laser diode 54) to emit a beam. When magnet 90 is pivoted to a second position removed from terminals 96 and 98, i.e., out of alignment with shell 94, as represented by the dashed lines in FIG. 4, the magnetic field no longer affects terminals 96 and 98 and the terminals 96 and 98 come out of contact with one another, opening the circuit so that the laser beam is not generated.

Figure 5:
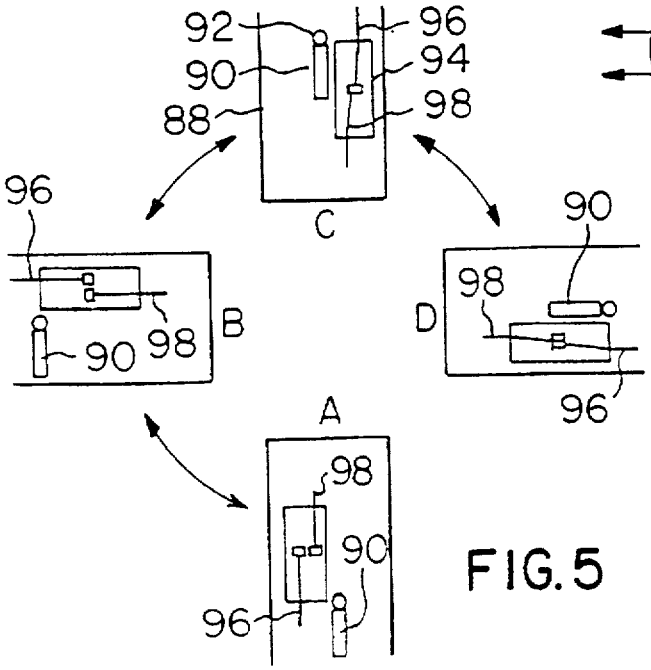
FIG. 5 is a schematic view showing operation of the gravity switch of FIG. 4 throughout a golf swing.

Referring to FIG. 5, the action of the gravity switch 86 throughout the swing of golf club 12 is diagrammed. At position A, the golf club is vertically oriented with the club head 16 on the ground and the grip 18 roughly just below the waist of the golfer 10. In this position, magnet 90, by gravity, is hanging from axis 92 in a position removed from the shell 94 and terminals 96 and 98. As the golfer brings the club back off the ground for the backswing, as shown in position B, magnet 90 pivots 90° about axis 92, maintaining its orientation by the force of gravity. At this point, the terminals 96 and 98 are still not in contact with one another, and the beam has not yet been radiated from the swing training device.

In position C, the golfer has further backswung the golf club so that the club is in a vertical position with the grip end of the club at the lower point and the club head 16 at the higher point. Magnet 90 pivots a further 90° about axis 92 to maintain its vertical position by force of gravity. Magnet 90 is then aligned near to shell 94. The magnetic field from the magnet thus causes terminals 96 and 98 to come into contact with one another, closing the circuit and resulting in radiation of the axial light beam 30 and perpendicular light beam 32 from swing training device 11. As the golfer completes the backswing, position D, the magnet 90 maintains its position near shell 94, controlled by stopper 100. The terminals 96 and 98 thus remain in contact with one another and the beams 30 and 32 continue to be radiated.

As the golfer reverses the swing and proceeds to the foreswing, the magnet is in position C, and the beams still radiate. As the club approaches the ground through position B and into the hitting position A, the magnet 90 is brought out of alignment with shell 94 and moves 90° to 180° to a position removed from shell 94, as shown by the dashed lines in FIG. 4. As the follow through is completed, the magnet 90 again returns to position D in FIG. 5 to be aligned with and near shell 94, causing the terminals 96 and 98 again to come into contact with one another, thereby radiating beams 30 and 32 so that the golfer may view his position during the follow through.

The magnet 90 thus rotates within an arc of 180° about axis 92 to switch on and off the beams 30 and 32. This insures that the beam only comes on when the club is in the backswing and follow through positions, avoiding radiation of the laser beams directly upward into the face of the golfer. Furthermore, this regulated radiation of the beams 30 and 32 maximizes the life of the power source 76 (batteries 50). The gravity switch 86 insures that the beams are radiated at the most critical points of the swing, in terms of teaching the golfer the proper position for backswing and follow through. Thus, referring again to FIG. 5, the backswing of golfer 10 causes the golf club 12 to move in sequence from position A through position D, and the foreswing and follow through causes the club to move back in the sequence of positions D through A. The gravity switch 86 insures that no manual switch operation is required, simplifying the use of swing training device 11.

Housing 44 generally has the shape of a rotary cylinder, thus maintaining the lines of the golf club 12 and shaft 14 and minimizing the chance that the housing 44 will interfere with the golfer's swing in some fashion. Preferably, housing 44 extends roughly two and one-half (2 ½) inches above the collar 68, 68' to ensure the light beams are not restricted by the golfer's arms or hands, while not extending so far as to hinder the motion of the golfer's arms or hands. An advantage of the knurled knob 74 in this regard is that it allows for adjustment of the length that housing 44 extends from the grip end of the shaft 14 to suit the user.

It is envisioned that a shortened golf club 12 may be desirable for training purposes, since regulation golf clubs are often too long to be useable indoors. A shortened club would avoid the problem of bumping walls, furniture, ceilings, etc., when swinging. The present invention is equally applicable to regulation golf clubs and shortened training clubs. Likewise, the invention is equally applicable to mens and ladies clubs, and to both right-handed and left-handed clubs.

Having described the presently preferred embodiments and best mode of the invention, it will be understood that various modifications may be made without departing from the spirit and scope of the invention. It is not intended to limit the invention except as set forth in the following claims.

What is claimed is:

1. A device for use with a shaft to provide visual feedback to a user who is swinging the shaft, comprising:

a power source;

a light source;

a driving circuit for driving the light source to emit a beam of light;

a beam splitter to convert said light beam into at least two parts, a first part being emitted along the axis of said shaft, a second part emitted at an angle with respect to said first part; and a gravity switch to regulate said light source so that said light source emits said light beam only when the shaft is in a predetermined position or positions.

2. The device of claim 1 wherein said shaft is part of a golf club, and said device is mounted on an end of said shaft opposite a club head, said gravity switch regulating said light source so that the light beam is emitted during the backswing and follow through to produce two points of light on a surface adjacent the golfer.

3. The device of claim 2 wherein said golf club is of the iron or wood type.

4. The device of claim 1 including a housing for said light source, driving circuit, power source, beam splitter and gravity switch, at least part of said housing received in said shaft.

5. The device of claim 4 including a collar for joining said housing to said shaft.

6. The device of claim 5 wherein said collar includes a set screw for securing the collar to the outside diameter of said shaft, said collar further including means for removably securing the housing within said collar.

7. The device of claim 4 wherein said housing includes a nesting portion having a smaller diameter than a remaining portion of said housing, said nesting portion received within the inside diameter of said shaft.

8. The device of claim 7 wherein said power source includes two dry batteries for supplying direct current electricity to said driving circuit, said batteries and said gravity switch being located within said nesting portion.

9. The device of claim 1 wherein said light source is a laser diode.

10. The device of claim 1 further including a collimator aligned with said light beam and positioned between said light source and said beam splitter.

11. The device of claim 10 wherein said collimator is a convex lens.

12. The device of claim 1 wherein said beam splitter is a half-mirror.

13. The device of claim 1 wherein said beam splitter includes two wedge-shaped prisms, joined to one another to form a cube.

14. The device of claim 1 including a rotary cap for housing said beam splitter, said rotary cap having at least two ports for passage of said light beams therethrough, said rotary cap facilitating adjustment of the radial direction of said second part of said beam.

15. The device of claim 14 including a lock washer for fixing the position of said rotary cap.

16. The device of claim 1 further including a mat for placing in front of the user, said mat having indicia to provide additional visual feedback to the user respecting the position of points of light created by said beams.

17. The device of claim 16 wherein said mat includes an alignment stripe, a first target zone and a second target zone.

18. The device of claim 1 including a main switch for activating said driving circuit.

19. The device of claim 18 wherein said main switch includes a spring-loaded post with a rotary sleeve having a varying inside diameter to depress and release said post, thereby activating and deactivating said main switch.

20. The device of claim 19 including a lock washer for fixing the position of said rotary sleeve.

21. The device of claim 1 wherein said gravity switch includes a first terminal and a second terminal, and further including a magnet pivotable about an axis, said terminals joining in contact with one another when said magnet is in a first position adjacent the ends of said terminals, said terminals moving out of contact with one another when said magnet pivots to a second position at least about 90° removed from said first position.

22. The device of claim 21 including a stopper to limit the range of motion of said magnet to an arc of approximately 180°.

23. The device of claim 21 including a shell for containing said terminals, said magnet located outside of said shell.

24. The device of claim 21 wherein said gravity switch is located within a casing, said casing having the shape of a battery with a positive contact on one end of said casing and a negative contact on an opposite end of said casing.

25. A swing training device for a golf club having a shaft with a club head at one end and a grip end opposite said club head, said swing training device comprising:

a housing having a power source, a driving circuit, a light source and a beam splitter therein, said housing adapted for installation on the grip end of said shaft;

at least two ports in said housing for passage of light beams therethrough, a first port being concentric with the longitudinal axis of said housing, a second port having a central axis which intersects said longitudinal axis at an angle;

said beam splitter dividing and directing light beams from said light source through said first and second ports;

a main switch for activating said driving circuit;

a collimator for creating parallel beams of light from said light source; and a gravity switch for regulating said power source so that when said driving circuit is activated, said light source produces a light beam when the housing is in a back-swing or follow through position.

26. The swing training device of claim 25 wherein said light source comprises a laser diode and said driving circuit comprises a laser driver, said light beam being a laser beam.

27. The swing training device of claim 25 wherein said beam splitter is a half-mirror.

28. The swing training device of claim 25 wherein said beam splitter is a pair of wedge-shaped prisms adhered together to form a cube.

29. The swing training device of claim 25 wherein said power source comprises at least one dry battery.

30. The swing training device of claim 29 wherein said gravity switch is housed in a casing which has the shape of a battery, said casing having a metal contact on either end of the casing, said casing disposed in the housing and in contact with said at least one battery.

31. The swing training device of claim 25 wherein said housing has a nesting portion, said nesting portion receivable in an inner diameter of said golf club shaft at said grip end, said swing training device further including a collar for joining said nesting portion to said golf club shaft.

32. The swing training device of claim 25 wherein said beam splitter is housed in a rotary cap on said housing, said cap rotatable about the longitudinal axis of said housing.

33. The swing training device of claim 25 wherein said main switch comprises a rotary sleeve which may be angularly displaced about the longitudinal axis of said housing, with a spring-loaded post extending between said driving circuit and an inner surface of said sleeve, said sleeve having a varying inner diameter so that rotation of the sleeve alternately depresses and releases said post, thereby activating and deactivating said driving circuit, respectively.

34. The swing training device of claim 25 wherein said gravity switch comprises two opposed terminals and a pivoting magnet, said terminals joining in contact with one another when said magnet is in a first position adjacent said terminals, said terminals moving out of contact with one another when said magnet pivots from said first position to a second position removed from said first position.

35. The swing training device of claim 25 including a mat on a surface in front of a golfer who is using said swing training device, said mat having indicia which provides additional visual feedback to said golfer according to the position of points of light generated by said light source on said mat.

36. A swing training device, comprising:

a shaft having a grip end and a distal end opposite said grip end;

a housing having at least one battery, a laser driver, a laser diode, a collimating lens and a beam splitter therein, said housing having a nesting portion receivable in said grip end of said shaft;

means for removably securing said housing to said grip end of said shaft;

a cap on said housing, said cap having a first port concentric with the longitudinal axis of said shaft and a second port whose central axis is perpendicular to said longitudinal axis, said cap containing said beam splitter, said cap rotatable about the longitudinal axis of said shaft;

a main switch for activating and deactivating said laser driver, said main switch having a spring-loaded post which extends radially outward from said housing;

a rotary sleeve on said housing, a portion of an inner surface of said rotary sleeve defining a slot having a greater inside diameter than a remainder of said sleeve to receive said post so that reciprocating angular displacement of said sleeve about the longitudinal axis of said housing will alternately depress and release said post, thereby activating and deactivating said laser driver;

a gravity switch in said housing, said gravity switch having two terminals and a pivoting magnet, said terminals contacting one another to complete a circuit between said at lease one battery and said laser driver when said magnet is in a first position adjacent said terminals; and said terminals moving apart from one another when said magnet pivots to a second position removed from said terminals, said magnet pivoting in response to the force of gravity when said shaft is being swung.

* * * * *